US005285565A

United States Patent [19]

Ballard et al.

[11] Patent Number: 5,285,565

[45] **Date of Patent: * Feb. 15, 1994**

[54] METHOD FOR MAKING A TRANSFORMER CORE COMPRISING AMORPHOUS STEEL STRIPS SURROUNDING THE CORE WINDOW

[75] Inventors: Donald E. Ballard, Conover; Willi Klappert, Hickory, both of N.C.

[73] Assignee: General Electric Company, Malvern, Pa.

[ * ] Notice: The portion of the term of this patent subsequent to Sep. 24, 2008 has been disclaimed.

[21] Appl. No.: 746,235

[22] Filed: Aug. 14, 1991

Related U.S. Application Data

[63] Continuation of Ser. No. 622,364, Dec. 5, 1999, Pat. No. 5,050,294, which is a continuation of Ser. No. 505,593, Apr. 6, 1990, abandoned.

[51] Int. Cl.[5] ..... H01F 41/02

[52] U.S. Cl. ..... 29/609; 29/738; 336/213; 336/217; 336/234

[58] Field of Search ..... 29/609, 605, 606, 738; 336/212, 213, 216, 217, 234

[56] References Cited

U.S. PATENT DOCUMENTS

| | | | |
|---|---|---|---|
| 3,049,793 | 8/1962 | Cooper | 29/155.57 |
| 4,413,406 | 11/1983 | Bennett et al. | 29/609 |
| 4,734,975 | 4/1988 | Ballard et al. | 29/609 |
| 4,741,096 | 5/1988 | Lee et al. | 29/605 |
| 4,972,573 | 11/1990 | Yamamoto et al. | 29/609 |
| 5,050,294 | 9/1991 | Ballard et al. | 29/609 |
| 5,093,981 | 3/1992 | Ballard et al. | 29/609 |

*Primary Examiner*—Carl E. Hall

*Attorney, Agent, or Firm*—Henry J. Policinski; William Freedman

[57] ABSTRACT

This method is practiced by first providing a plurality of spools of amorphous steel strip in each of which the strip is wound in single-layer thickness. Then, in a pre-spooling machine, the single-layer thickness strips are unwound from said plurality of spools and combined to form strip of multiple-layer thickness which is wound onto a plurality of master reels, on each of which the strip is wound in multiple-layer thickness. These master reels are then placed on a plurality of payoffs, and the multiple-layer thickness strip is unwound from these payoffs and combined into a composite strip that has a thickness in strip layers equal to the sum of the strip layers in the combined multiple-layer thickness strips. Then the composite strip is cut into a plurality of sections, or lengths, of composite strip, and with these sections a hollow core form is constructed, which form has a window about which the sections are wrapped.

4 Claims, 2 Drawing Sheets

METHOD FOR MAKING A TRANSFORMER CORE COMPRISING AMORPHOUS STEEL STRIPS SURROUNDING THE CORE WINDOW

This is a continuation of application Ser. No. 622,364, filed Dec. 5, 1990, issued as U.S. Pat. No. 5,050,394 which is a continuation of application Ser. No. 505,593, filed Apr. 6, 1990, now abandoned.

This invention relates to a method for making an electric transformer core that comprises thin strips of amorphous steel arranged in sections of multiple-strip thickness that surround the window of the core.

BACKGROUND

Typically, the amorphous steel strip used for such transformer cores is very thin, e.g., only about one mil in thickness as compared to the 7–12 mils typical for grain-oriented silicon steel. One basic approach to making a core from such amorphous steel strip involves unwinding from a spool of strip material an essentially continuous length of strip, cutting from this continuous length sections of appropriate length, and then wrapping these sections about an arbor or the like in appropriate angular positions on the arbor. To make the core assembly process an economical one, it is highly desirable that many essentially continuous strips of the above type, e.g., 10 to 30, be formed into a composite strip and that this composite strip be cut to form sections of multiple-strip (or multiple-layer) thickness that have appropriate lengths. These latter sections can be much more easily and quickly handled than an equivalent number of sections of single-strip (or single-layer) thickness.

One approach for forming the above-described composite strip involves, first, taking spools of strip steel (in the single layer form the strip is received from the mill) and placing such spools on reels (or payoffs) equal in number to the number of thickness layers desired in the composite strip. Then, according to such approach, strip from all these reels is unwound simultaneously, and the unwound portions of such strip are combined in layers to form the desired multiple-layer composite strip.

This approach requires a very large and expensive machine if the composite strip is to have the desired large number of layers. For example, to produce strip of 20 layers would require 20 payoff stands. These payoff stands are expensive, and twenty of them would consume a large amount of floor space as well as being unduly expensive. Another problem with 20 single-strip thickness payoffs is that strips of single-layer thickness are prone to break, and each such break would necessitate stopping the machine. This tendency to break strips would be especially severe in a machine where the feed from the spools is discontinuous, and the strips are thus subjected to repeated decelerating and accelerating forces.

Another approach for making an amorphous steel core involves winding up an annulus of amorphous steel strip derived from a single spool and then cutting the annulus along a radial line to produce a multiplicity of separate strips of appropriate length which fall into a stack. Thereafter, the strips are taken from the stack in groups of multiple-strip thickness and these groups are assembled about an arbor, typically using for this purpose a belt nester that includes a rotating arbor. Examples of this approach are disclosed in our U.S. Pat. No. 4,734,975 and in U.S. Pat. No. 4,741,096-Lee and Ballard, both assigned to the assignee of the present invention.

In this latter approach, as pointed out above, each core is typically made from strip derived from a single spool. While using this approach greatly reduces the number of payoff stands required for the core-making machine, as compared to the earlier-described machine, it is subject to the disadvantage that the space factor of the resulting core is often not as high as might be desired. If the strip material on the starting spool has a low space factor, then the final core will almost always have a low space factor. We have found that by making the core from strip derived from several spools, instead of a single spool, we can produce cores with much more uniform space factors of the desired high level.

For this latter reason, and several others, we utilize for making each core a method that employs strip derived from a plurality of spools. This approach has the additional advantage that we are able to match the strip material present in each core for both physical and electrical characteristics. The manufacturer of the strip typically supplies with each spool data as to the space factor, cross-section, and magnetic properties of the strip in that particular spool. By selecting appropriate combinations of strip, we can more accurately predict the core build and the magnetic losses for the resulting core, and this ability helps us in designing and manufacturing an economical amorphous metal transformer.

OBJECTS

An object of our invention is to provide a method which utilizes, for making each amorphous steel core, strip from many spools of strip but yet requires only a relatively small number of payoffs, or reels, for feeding strip to the strip-cutting and strip-wrapping portions of the core-making machine.

Another object is to provide a core-making method in which composite amorphous steel strip comprising n individual strips stacked together can be produced from individual strips derived from less than n spools of strip by relatively inexpensive apparatus that does not require an undue amount of floor space adjacent the strip-cutting and strip-wrapping or nesting portions of the core-making machine.

SUMMARY

In carrying out the invention in one form, we provide the following method for making a transformer core comprising strips of amorphous steel wrapped about the window of the core. First, we provide a plurality of spools of amorphous steel strip in each of which the strip is wound in single-layer thickness. Then, in apparatus that we refer to as a pre-spooler, we simultaneously unwind the single-layer thickness strips from said plurality of spools and combine the single-layer thickness strips to form a strip of multiple-layer thickness, which we wind onto a plurality of master reels, on each of which the strip is wound in multiple-layer thickness. Then, we place these master reels on payoffs, unwind the multiple-layer thickness strips from the master reels, and combine the unwound portions of these multiple-layer strips into a composite strip that has a thickness in strip layers equal to the sum of the combined multiple-layer thickness strips. Then we cut the composite strip into a plurality of sections of composite strip, and with these sections, we build a hollow core form having a window about which the sections are wrapped.

BRIEF DESCRIPTION OF FIGURES

For a better understanding of the invention, reference may be had to the following description taken in conjunction with the accompanying drawings, wherein.

DETAILED DESCRIPTION OF EMBODIMENTS

Figure 1:
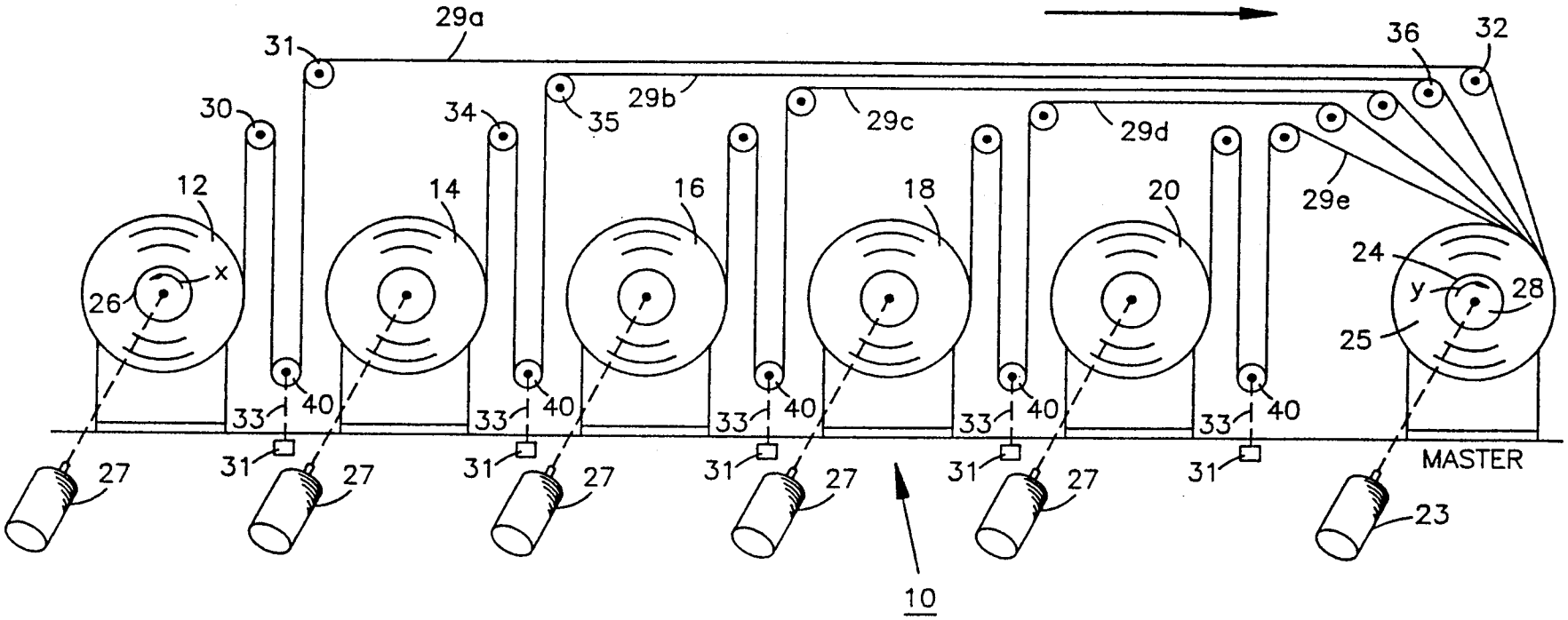
FIG. 1 is a schematic showing of a pre-spooler in which single-layer thickness strip is unwound from five starting spools of amorphous steel strip and combined into multiple-layer thickness strip that is wound into a master spool.

Referring now to FIG. 1, there is shown a pre-spooler 10 which is adapted to receive five starting spools 12, 14, 16, 18, and 20 of amorphous steel strip. These starting spools are spools received from the steel mill, and, accordingly, in each starting spool the strip is of single-layer thickness. The basic purpose of the pre-spooler is to combine the single-layer thickness strips from the starting spools 12, 14, 16, 18, and 20 into multiple-layer thickness strip which is wound onto a master reel 24 as a master spool 25.

Each starting spool is mounted on a fixed-axis rotatable spindle 26 which is coupled to the rotor of an adjustable speed electric motor 27, which motor, when energized drives the spindle 26 in a counterclockwise direction (as indicated by arrow x) to effect unwinding of the associated starting spool. The master reel 24 is mounted on a fixed-axis rotatable spindle 28, which is also coupled to the rotor of an electric motor (23), which normally operates at a substantially constant speed. The latter motor, when energized, drives the spindle 28 in a clockwise direction (as indicated by arrow y) to wind the multiple-layer thickness strip onto the master reel 24. The single-layer thickness strip unwound from each starting spool is directed over a series of guide rollers onto the master reel 24. These single-layer thickness strips are designated 29*a*, 29*b*, 29*c*, 29*d*, and 29*e*.

The guide rollers for the strip from the first starting spool 24 are designated 30, 31, and 32. The guide rollers for the strip from the second starting spool are designated 34, 35, and 36. Corresponding guide rollers are present for the strip unwound from each starting spool.

The single-layer thickness strips from the five starting spools are combined into a multiple-layer thickness strip at the periphery of the master spool 25, and this multiple-layer thickness strip is wound onto the master spool 25 as the spindle 28 of the master reel is driven in a clockwise direction.

For maintaining each single-layer thickness strip under appropriate tension as it is being wound onto the master reel 24, a tensioner roller 40 is provided adjacent each starting spool, acting on a downwardly extending loop 41 in the associated strip located between two of the guide rollers for the strip. Each of these tensioner rollers 40 is mounted in a conventional manner for vertical motion, being gravity biased in a downward direction by a suitable weight. This gravity bias,, acting on the strip through roller 40, keeps the strip taut, thus assuring that the multiple-layer thickness strip is smoothly and tightly wound onto the master reel 24. In one embodiment of the invention, each tensioner roller 40 is biased downwardly with a weight of about 1.5 pounds for each inch of strip width.

For controlling the unwinding of the starting spools as the multiple-layer thickness strip is being wound onto the master reel 24, a suitable control 31 is provided for each starting-spool electric motor 27. This control 31, which is of a conventional form, operates off a dancer arm, schematically indicated at 33, that moves up and down with the tensioner roller 40. The control 31 causes its associated motor 27 to operate at a speed which depends upon the vertical position of the tensioner roller 40. As the starting spool (e.g., 12) decreases in diameter through unwinding and the master spool 25 increases in diameter through winding, the amount of unwound strip material between the two spools (12 and 25) will tend to decrease, thus shortening the loop 41 and causing the tensioner roller 40 to rise. Control 31 responds to this rise in the position of the tensioner roller 40 by causing the motor 27 to increase its speed, thereby making available more unwound strip material and causing the tensioner roller to descend to its normal vertical position shown. If the tensioner roller descends beyond its normal vertical position shown, the control 31 will cause the motor 27 to reduce its speed, thus shortening loop 41 and returning the tensioner roller 40 to its normal vertical position shown.

It will thus be seen that the tensioner roller 40 and control 31 cooperate (i) to maintain substantial tension on each of the single-layer thickness strips as it is being wound onto the master spool 25 and (ii) to effect unwinding of the starting spools at appropriate speeds without requiring all the unwinding forces to be transmitted through the single-layer thickness strip.

When a master spool 25 of the desired build has been wound on reel 24, the master spool is removed from the drive spindle 28 and put aside for subsequent use. To make possible removal of the master spool, the single-layer thickness strips 29*a–e* are suitably cut at a location adjacent the master spool just prior to removal.

After a first master spool has been built up as above described and then removed from drive spindle 28, additional master spools are built up in the same manner on the drive spindle 28, each being removed upon completion to allow the next one to be built up. Then, four of the master spools 25 are loaded on the four payoff reels 50 of the core-making apparatus shown in FIG. 2.

Figure 2:
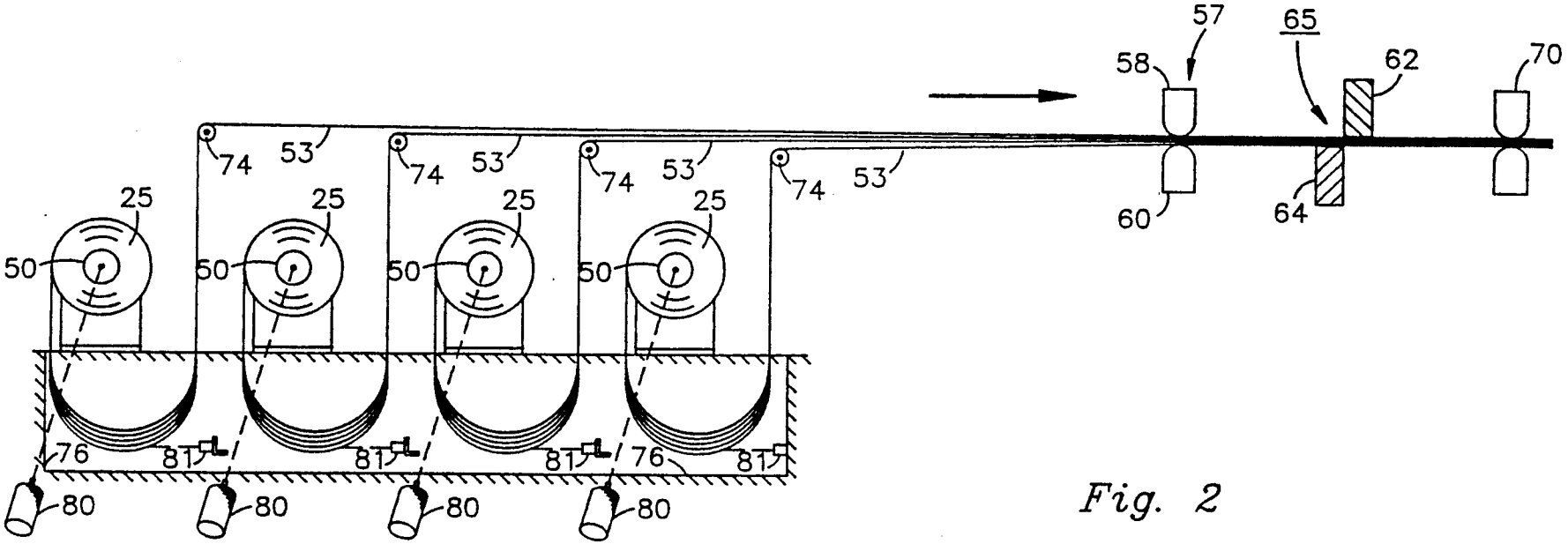
FIG. 2 is a schematic showing of apparatus that combines multiple-layer thickness strips unwound from four master spools into a composite strip that is fed forward and sheared into lengths of composite strip. The apparatus of FIG. 2 receives the master spools from the pre-spooler of FIG. 1.

As further shown in FIG. 2, the multiple-layer thickness strips 53 in the master spools 25 are unwound from their respective master spools and combined into a composite strip 55. This composite strip 55 has a strip thickness equal to the total number of single-layer strips in all of the master spools 25 depicted in FIG. 2. In the illustrated embodiment, each of the multilayer strips 53 in each of the master spools 25 is five layers in thickness, and, accordingly, the composite strip 55 is $4 \times 5$, or 20, layers in thickness.

In unwinding from their master spools 25 and traveling into the location where they are combined to form the composite strip 55, each of the strips 53 of FIG. 2 passes through a pit 76 common to and beneath all the master spools 25 and then over a guide roll 74, where the orientation of each strip is changed from generally vertical to generally horizontal. After passing over the guide rolls 74, the strips are directed in gradually converging relationship into the composite strip 55. The portion of each multiple-layer thickness strip 53 between its associated master spool and its guide roll 74 hangs downwardly in a loop that is located in the pit 76. The weight of the strip 53 in this loop 75 exerts tensile forces on the associated strip 53 as it enters the composite strip 55, thus keeping the strip 53 taut just upstream from the location where it is combined with the other strips, thus reducing the chances for wrinkles and other irregularities in the composite strip.

The composite strip 55 is advanced to the right in FIG. 2 by strip-feeding means 57 comprising a pair of clamping elements 58 and 60. These clamping elements are movable toward and away from each other and are also movable in unison horizontally. In FIG. 2, the clamping elements are shown in their extreme left-hand location and in their minimum spacing position clamping the composite strip 55 on its upper and lower faces. When the clamping elements 58 and 60 move to the right from their position of FIG. 2, they advance the composite strip to the right between the spaced-apart blades 62 and 64 of a shearing device 65.

Assisting the strip-feeding means 57 is additional strip-feeding means 70 located downstream from the blades 62 and 64. When this downstream strip-feeding means 70 becomes effective, the clamping elements 58 and 60 of the first strip-feeding means 57 are separated from each other to release the composite strip 55 and are reset by movement in unison to the left back toward their initial position of FIG. 2. When the strip-feeding means 70 has properly positioned the composite strip by further movement to the right, it also unclamps the composite strip and returns to the left to its initial position of FIG. 2.

For controlling unwinding of the master spools 25 in the apparatus of FIG. 2, each of the payoff reels 50 is coupled to the rotor of an electric motor 80. As the composite strip 55 is fed to the right the motor rotates its associated payoff reel in a counterclockwise direction, making unwound strip material available for the composite strip 55. As noted hereinabove, in the pit 76 beneath each master spool 25 the strip unwound from each master spool hangs down into a loop 75. Each of the individual strips forming the multiple-layer strip hangs down in its own loop, and the vertical spacing between these loops becomes increasingly larger as the associated master spool unwinds. A photoelectric control 81 for each multiple-layer strip 53 is located within, or adjacent, the pit 76 and operates off the lowermost loop 75 of each multiple-layer strip 53 (i) to cause the motor 80 associated with that strip 53 to start and unwind the strip at gradually increasing speed if the loop rises above a predetermined upper limit and (ii) to cause the motor to decelerate to a stop if the loop falls below a predetermined lower limit.

Referring still to FIG. 2, the two strip-feeding means 57 and 70, in moving to the right, cause the composite strip 55 to be intermittently advanced to the right; and this causes the horizontal portions of the multi-layer strips 53 to be advanced intermittently to the right. As the horizontal portions of the strips 53 are thus intermittently advanced to the right, the master spools 25 are unwound by their respective motors 80, making available strip material in the loops 75. From these loops the multi-layer strip material 53 is pulled by feed means 57 and 70 and combined into the composite strip 55. During these operations, the horizontal portion of each of the multi-layer strips 53 is maintained under tension by the weight of the loops 75 in the pit 76.

When the composite strip 55 of FIG. 2, has been advanced to the right to the desired position, it is cut by operation of the shear blades 62 and 64. These shear blades are preferably constructed as shown and claimed in patent application Ser. No. 334,248—Taub et al. issued as U.S. Pat. No. 4,942,798, filed on Apr. 6, 1989, and assigned to the assignee of the present invention.

In operating, the shear blades cut the composite strip 55 into sections of composite strip having the desired lengths. These sections are stacked up and then wrapped around an arbor to develop a hollow core form, preferably in the manner shown and claimed in our U.S. patent application Ser. No. 463,697, issued as U.S. Pat. No. 5,093,981 filed Jan. 1, 1990, and assigned to the assignee of the present invention, which application is incorporated by reference herein.

It will be apparent from the above description that we have used a total of nine payoff stands, five in the pre-spooler and four in the apparatus of FIG. 2, to form composite strip twenty (20) layers in thickness. If we had used the approach referred to under "BACKGROUND" as the first approach, we would have used for forming this 20-layer composite strip twenty payoff stands, each receiving a starting spool of single-layer thickness strip. Such single-layer thickness strip would be simultaneously unwound from these twenty starting spools to form the desired twenty layer composite strip. It will be apparent that by using our approach instead, we have reduced the number of payoff stands required from 20 to 9. This not only has greatly reduced the cost of the machine and the amount of floor space required but has also reduced chances that strip will be broken by the machine since the strip in our machine is, for the most part, handled in multi-layer thickness form instead of single-layer thickness form. This is especially important in the machine of FIG. 2, where the composite strip is being accelerated and decelerated (and thus more severely loaded) by the intermittent strip-advancing and stopping action that is present.

Another important advantage of our invention is that we can use the pre-spooler of FIG. 1 to produce enough multiple-layer strip material to supply many continuously-operating core-making machines (such as the machine of FIG. 2). Or, stated in another way, while the machine of FIG. 2 is producing lengths of composite strip 55 from multiple-layer strip 53 derived from four master spools (25), the pre-spooler of FIG. 1 can layer strip. This means that the average number of payoff stands required for the operation of each core-making machine is reduced by a substantial number (from the nine noted above), and the average amount of floor space required for the combined pre-spooling and composite strip-making operations of FIGS. 1 and 2 is further reduced.

Still another advantage of our invention is that the pre-spooler of FIG. 1 can be at a location substantially removed from the apparatus of FIG. 2, thus providing more flexibility for plant-layout purposes.

While we have specifically illustrated a pre-spooler (FIG. 1) with five payoff stands combined with a core-making machine of four payoff stands, it is to be understood that this particular total number of payoff stands is illustrative only. Fewer or more payoff stands could be present in each of these machines. For example, in another form of this invention, we use the illustrated pre-spooler in combination with a core-making machine of the type shown in FIG. 2 but having three payoff stands instead of four. This combination produces composite strip (55) of $5 \times 3$, or 15, layers in thickness.

Under "BACKGROUND" hereinabove, we have mentioned a second approach for constructing amorphous metal cores that involves winding up an annulus of amorphous strip derived from a single spool and then cutting this annulus along a single radial line to produce a multiplicity of strips of appropriate length. While using this approach greatly reduces the number of payoff stands required for the core-making machine, it is subject to the disadvantage that the space factor of the resulting core is often not as high as might be desired. If the strip material on the starting spool has a low space factor, then the final core will almost always have a low space factor. We find that by making the core from strip derived from a plurality of spools (for example, the five separate starting spools shown in FIG. 1), instead of a single spool, we can produce cores with much more uniform space factors of the desired high level.

A reduced space factor is often due to high spots at restricted locations along the width of the strip. If the strip is wound into a core form so that adjacent turns of the same strip contact each other, the high spots will tend to line up and thus multiply the effect of the high spots, and the result will be a core form of relatively low space factor. But if strips from a multiplicity of spools are used, any high spots on contiguous strips will usually be out of alignment with each other, thus averaging out the effect of the high spots and producing a core form of higher space factor.

This averaging-out effect can be promoted by carefully selecting adjacent strips to be of compatible cross-sectional configuration, but we have found that simply through random selection we can produce cores with much more uniform space factors of the desired high level, as compared to those present in cores made from strip derived from a single spool.

The manufacturer of the strip typically supplies with each spool data as to space factor, cross-section, and magnetic properties of the strip in that particular spool. By selecting appropriate combinations of strip for a single core form, we can more accurately predict the core build that will result from a particular number of laminations and also the magnetic losses for the resulting core. This ability helps us in designing and manufacturing an economical amorphous metal transformer.

An important point to note with respect to our method is that the pre-spooler of FIG. 1 winds the single-layer thickness strips 29*a–e* onto the master reel 24 with considerable tightness. This tightness results primarily from the gravity-biased tensioner rollers 40 (FIG. 1) acting on the single-layer thickness strips. The tightness of the master spools 25 controls the vertical spacing that develops between the loops 75 in the individual strips illustrated in FIG. 2. If the master spools had been relatively loosely wound, this vertical spacing would become much greater than shown, and a much deeper pit would have been required to accommodate the loops developed in the pit. We are able to avoid the costs associated with providing this increased depth in the pit 76.

It is to be understood that any desired number of master spools 25 constituting the output from the pre-spooling machine 10 of FIG. 1 can be accumulated before individual master spools are taken from this accumulated output for utilization in the apparatus of FIG. 2. This accumulated output may be derived from the starting spools 12, 14, 16, 18, 20 of FIG. 1, as well as from additional starting spools corresponding to the starting spools 12, 14, 16, 18, 20 of FIG. 1. Similarly, the output from one or more additional pre-spooling machines, each corresponding to that of FIG. 1, can also be included in the accumulated output from which the master spools 25 are taken for use in the apparatus of FIG. 2.

While we have shown and described a particular embodiment of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. A method of making a transformer core comprising strips of amorphous metal wrapped about a window of the core, said method comprising the steps of:

(a) providing a first plurality of spools of amorphous metal strips;

(b) from said first plurality of spools selecting a second plurality of spools containing amorphous metal strip having preselected magnetic properties;

(c) unwinding said amorphous metal strip from each of said spools in said second plurality and combining said strip from each of said spools in said second plurality into a strip of multiple layer thickness;

(d) unwinding the multiple-layer thickness strips from a plurality of master reels wound with multiple-layer thickness strips provided as in (a) (b) and (c) and combining said multiple-layer thickness strips into a composite strip, and (f) constructing with said composite strip a hollow core form having a window about which said composite strip is wrapped.

2. A process of making a plurality of transformer cores, each core being made in accordance with the method of claim 1, and in which:

the spools in the second plurality of spools from which each core is made are selected based upon magnetic loss properties that average out in the completed core so that the cores made by said process have essentially uniform magnetic loss properties.

3. A method of making a transformer core comprising strips of amorphous metal wrapped about a window of the core, said method comprising the steps of:

(a) providing a first plurality of spools of amorphous metal strip;

(b) from said first plurality of spools selecting a second plurality of spools having preselected space factors;

(c) unwinding said amorphous metal strip from each of said spools in said second plurality of combining said strip from each of said spools in said second plurality into a strip of multiple layer thickness;

(d) winding said multiple-layer thickness strip onto a master reel, (e) unwinding the multiple-layer thickness strips from a plurality of master reels wound with multiple-layer thickness strips provided as in (a) (b) and (c) and combining said multiple-layer thickness strips into a composite strip, and (f) constructing with said composite strip a hollow core form having a window about which said composite strip is wrapped.

4. A process of making a plurality of transformers cores, each core being made in accordance with the method of claim 3, and in which the spools in the second plurality of spools from which each core is made are selected based upon space factors that average out in the completed core so that the cores made by said process have essentially uniform space factors.

* * * * *

UNITED STATES PATENT AND TRADEMARK OFFICE

CERTIFICATE OF CORRECTION

PATENT NO. : 5,285,565

DATED : February 15, 1994

INVENTOR(S) : D.E. Ballard & W. Klappert

It is certified that error appears in the above-identified patent and that said Letters Patent is hereby corrected as shown below:

Column 6, line 46, after "can" the following should be inserted -- produce several times this many master spools of multi- --

Col. 8,
Claim 1, between the paragraphs designated (c) and (d) in the the patent as issued, the following paragraph should be inserted:

-- (d) winding said multiple-layer thickness strip onto a master reel, --

Claim 1, line 24 of the claim, "(d)" should be changed to -- (e) --

Claim 3, line 49 of the claim, "of" should be changed to -- and --

Signed and Sealed this

Sixteenth Day of August, 1994

Bruce Lehman

*Attest:*

BRUCE LEHMAN

*Attesting Officer*

*Commissioner of Patents and Trademarks*